US007927009B2

(12) United States Patent
Huang

(10) Patent No.: US 7,927,009 B2
(45) Date of Patent: Apr. 19, 2011

(54) WATCH WINDER

(75) Inventor: Wen-Hsin Huang, Taichung (TW)

(73) Assignee: Abest Products Resourcing Inc., Taichung (TW)

( * ) Notice: Subject to any disclaimer, the term of this patent is extended or adjusted under 35 U.S.C. 154(b) by 138 days.

(21) Appl. No.: 12/344,517

(22) Filed: Dec. 27, 2008

(65) Prior Publication Data

US 2010/0165798 A1 Jul. 1, 2010

(51) Int. Cl.
*G04B 3/00* (2006.01)

(52) U.S. Cl. ..... 368/206; 81/7.5; 439/701

(58) Field of Classification Search ..... 368/206; 439/701; 81/7.5
See application file for complete search history.

(56) References Cited

U.S. PATENT DOCUMENTS 4,423,465 A * 12/1983 Teng-Ching et al. ..... 361/730
4,457,721 A * 7/1984 Charvolin ..... 434/224
4,756,415 A * 7/1988 Call ..... 206/703
5,984,732 A * 11/1999 Mehring ..... 439/701
7,025,495 B2 * 4/2006 Colarieti ..... 368/206
7,270,474 B2 * 9/2007 Agnoff ..... 368/206
7,575,367 B2 * 8/2009 Wolf et al. ..... 368/206
2002/0089820 A1 * 7/2002 Abboud ..... 361/685
2002/0136095 A1 * 9/2002 Agnoff ..... 368/206
2005/0254352 A1 * 11/2005 Wolf et al. ..... 368/206
2005/0265129 A1 * 12/2005 Agnoff ..... 368/206
2007/0223319 A1 * 9/2007 Hill ..... 368/206

* cited by examiner

*Primary Examiner* — Renee S Luebke
*Assistant Examiner* — Jason Collins

(57) ABSTRACT

A watch winder comprising plural watch winder units and a power supply. The plural watch winder units are assembled by connectors in such a manner that the watch winders units are electrically connected to one another, and the power supply is electrically connected to one of the watch winder units to supply power to all the electrically-connected watch winder units. By such arrangements, the respective watch winder units are not required to be provided with one power supply, thus saving the manufacturing cost, satisfying the requirements of environmental protection, and the watch winder units can be assembled as desired.

8 Claims, 5 Drawing Sheets

WATCH WINDER

BACKGROUND OF THE INVENTION

1. Field of the Invention

The present invention relates to a watch winder, and more particularly to a watch winder which can reduce the manufacturing cost and satisfy the environmental protection requirements through reduction of the number of power supplies.

2. Description of the Prior Art

Watch is not only one of the important inventions in the history of human but one of the indispensable tools in the modern daily life. The existing watches include two types: the modern common quartz watches and the early mechanical watches. Due to the advantages such as high accuracy and low price, the quartz watches have become more common today. In addition, some mechanical watches in which the interior mechanical components can produce power are also cherished by many people. Such mechanical watches must be manually wound by rotation of a stem or can be automatically wound up through the motion of the user's arm, in order to keep mechanical watches running, so that if the mechanical watches are determined to be out of use for a long time, they must be stored in an automatic watch winder, which is provided for holding the mechanical watches and winding the mechanical watches automatically to make the mechanical watches keep running. As for watch collectors who own lots of watches or watch venders, they need purchasing lots of watch winders. Nevertheless, the conventional watch winders are all independent, or each provided with two assembling portions, so that the watch winders can be assembled together, but the power supplies on the watch winders are also independent, namely each watch winder has one power supply. Therefore, from the manufacturer angle, the manufacturing cost is relatively high, and from environmental angle, the conventional watch winders are not environmental-friendly, further from the consumer angle, the number of power supplies is large, thus not only increasing the purchase cost but possibly causing danger.

The present invention has arisen to mitigate and/or obviate the afore-described disadvantages.

SUMMARY OF THE INVENTION

The primary objective of the present invention is to provide a watch winder comprising plural watch winder units that can be assembled to one another and electrically connected, so that it is unnecessary to dispose one power supply on the respective watch winder units to supply the power to the respective watch winder units of the watch winder, thus reducing manufacturing cost and satisfying environmental protection requirements.

In order to achieve the above objectives, a watch winder in accordance with the present invention comprises plural watch winder units each including at least one first connector and at least one second connector. The first connectors and the second connectors are all made of electrically-conductive material, and the first connector of one of the winder units is assembled in the second connector of the other of the winder units to electrically connect the two winder units, so that the plural watch winder units can be assembled and electrically connected to one another. By such arrangements, the assembled watch winder units only need one power supply, thus not only reducing the manufacturing cost but satisfying the environmental protection requirements. In addition, the watch winder units can be assembled as desired.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
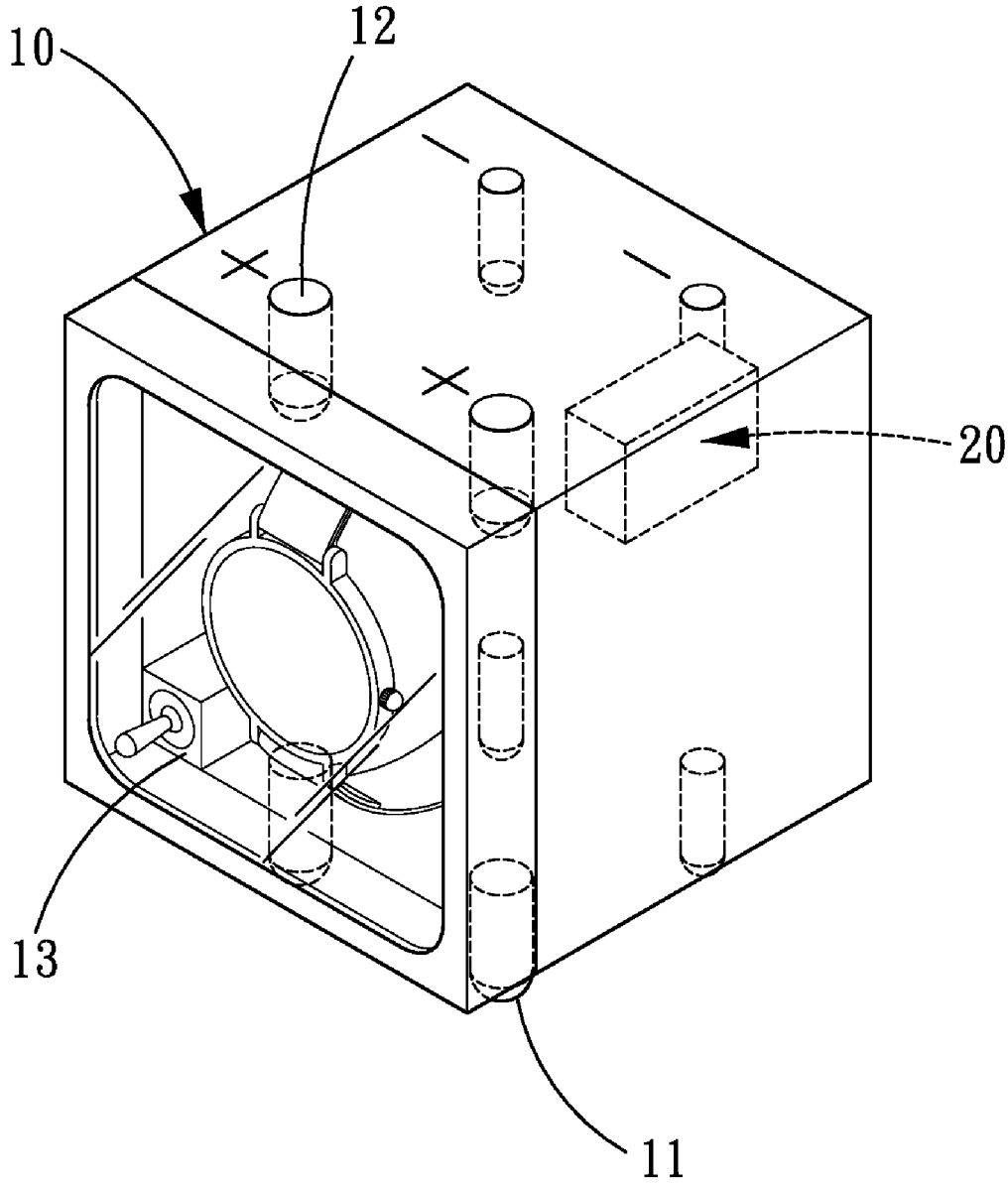
FIG. 1 is a perspective view of a watch winder in accordance with a first embodiment of the present invention.
Figure 2:
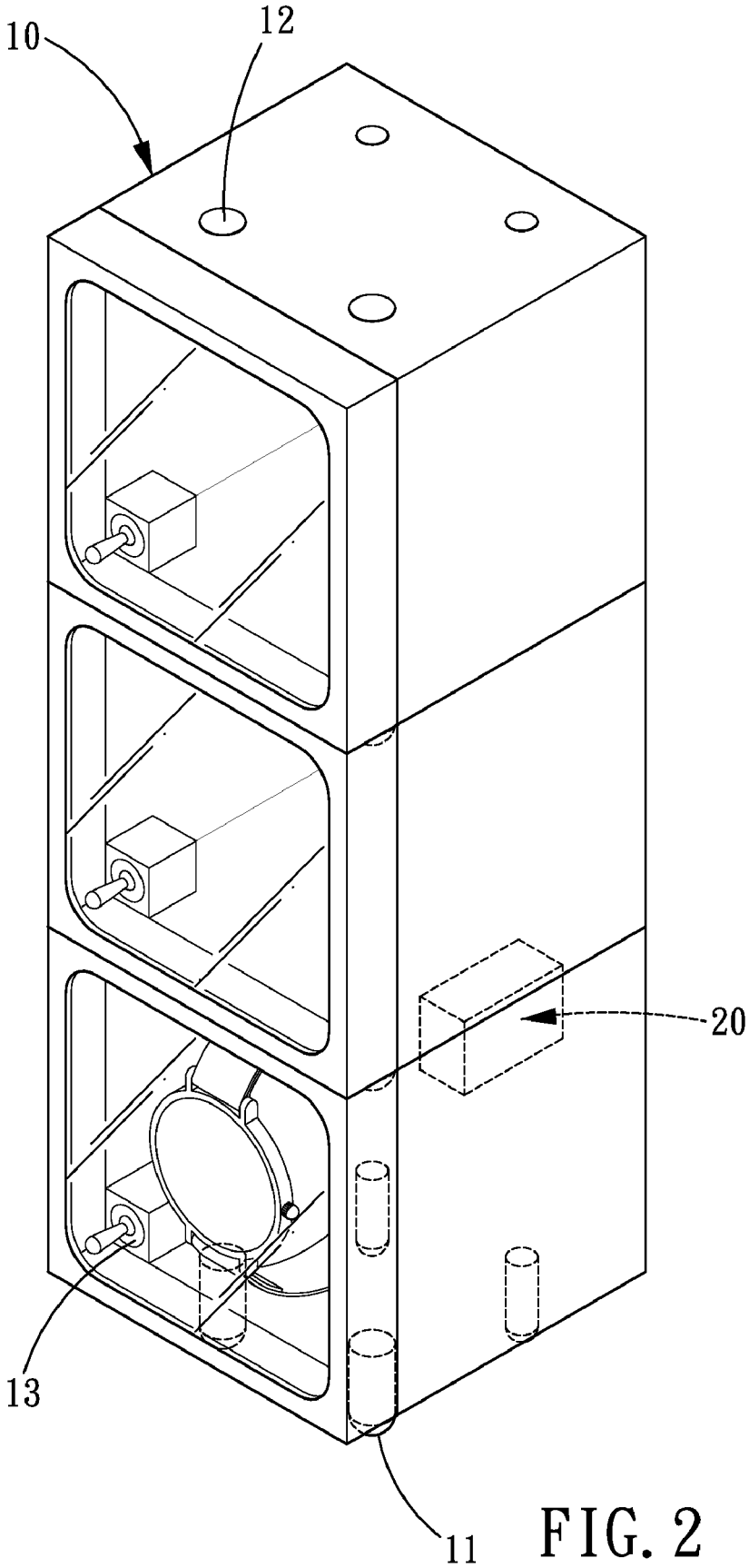
FIG. 2 is a perspective view of an assembly of three watch winder units of the first embodiment of the present invention.

Referring to FIGS. 1-2, a watch winder in accordance with a first embodiment of the present invention comprises plural watch winder units 10. Each of the watch winder units 10 includes four first raised connectors 11 that are located on one outer side thereof and four second concave connectors 12 that are located in another outer side thereof in alignment with the first connectors 11. The first connectors 11 and the second connectors 12 are all made of electrically-conductive material, such as copper or other metals, so that the first connectors 11 and the second connectors 12 are electrically conductive. As for the respective watch winder units, two of the four first connectors 11 are bigger than other two first connectors 11 in outer diameter, similarly, the two of the second connectors 12 which are in alignment with the two bigger-diameter first connectors 11 are correspondingly bigger in inner diameter than the other two second connectors 12. The first connectors 11 which have the same outer diameter are electrically connected to each other, and the second connectors 12 which have the same inner diameter are electrically connected to each other, so as to distinguish the electrical property of the different-sized first and second connectors 11, 12, for example, the electrical property of the bigger-diameter first connectors 11 and the bigger-diameter second connectors 12 is positive, and the electrical property of the smaller-diameter first connectors 11 and the smaller-diameter second connectors 12 is negative. The respective watch winder units 10 include a power switch 13. The first connectors 11 are assembled in the second connectors 12 to assemble the watch winder units 10 in such a manner that the watch winder units 10 can be electrically connected.

A power supply 20 is assembled to one of the watch winder units 10 in such a manner that the power supply 20 can be pre-provided in one of the watch winder units 10, or it can be provided outside one of the watch winder units 10 or externally connected to one of the watch winder units 10, and the power supply 20 is electrically connected to the first and second connectors 11, 12 of the one of the power units 10, respectively. The power switches 13 control on/off of the respective watch winder units 10.

The first connectors 11 are assembled in the second connectors 12 to finish the assembly of the watch winder units 10, so that the watch winder units 10 can be stacked one upon another, as shown in FIG. 2. Further, since the first connectors 11 and the second connectors 12 are all electrically conductive, the assembled watch winder units 10 are electrically connected to one another, and the power supply 20 can supply power to the respective watch winder units 10 without installing one power supply 20 on each watch winder unit 10, thus saving manufacturing cost and further satisfying requirements of environmental protection. Each of the watch winder units 10 includes one power switch 13, so that when one of the watch winder units 10 is required to be out of use, the power switch 13 on the one of the watch winder units 10 can be turned off to reduce the power waste without disassembling the assembled watch winder unit 10. When the watch winder units 10 are not used for winding the watches, they can be used for displaying the watches. In addition, the first connectors 11 and the second connectors 12 are designed to have different outer diameters and inner diameters, respectively, so that it is easy to distinguish the assembling positions, thus avoiding the assembly error and the occurrence of damage.

Figure 3:
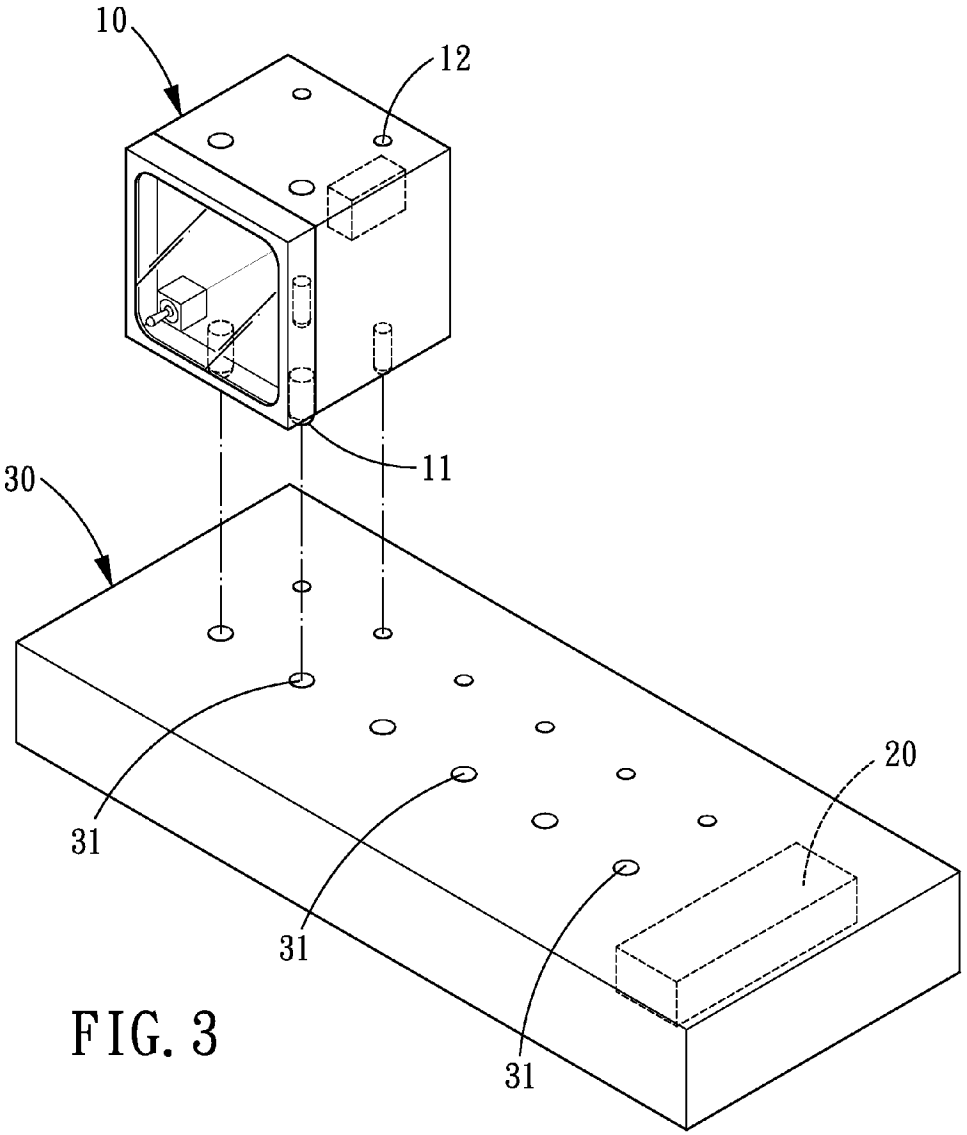
FIG. 3 is a perspective view of a base of the first embodiment in accordance with the present invention.
Figure 4:
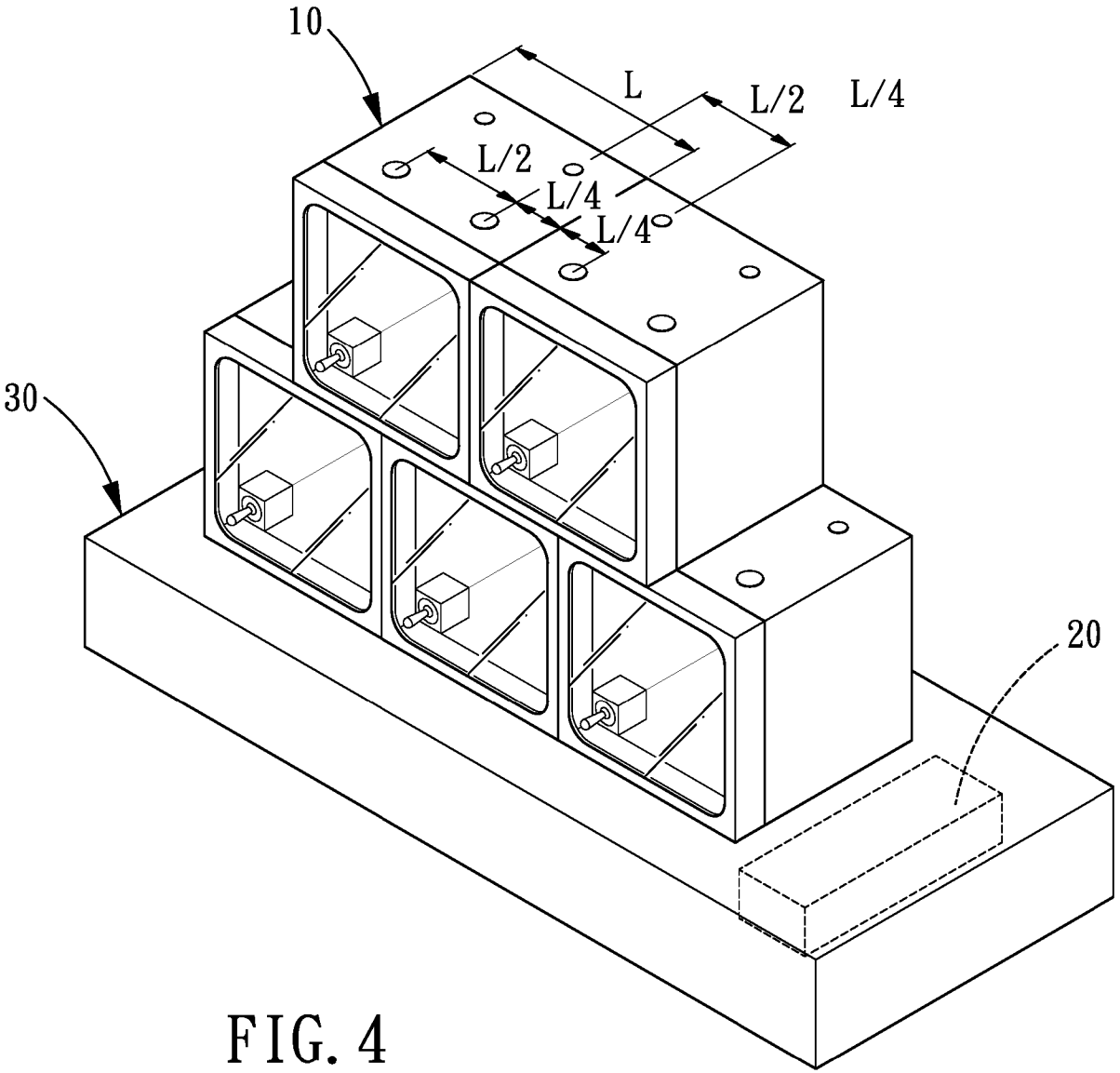
FIG. 4 is a perspective view illustrating that the watch winder units of the first embodiment in accordance with the present invention are assembled on the base.

Referring to FIGS. 3-4, a watch winder in accordance with a second embodiment of the present invention further comprises a base 30 on which plural watch winder units 10 are assembled.

A width of the respective watch winder units 10 is L, a distance between the two first connectors 11 which have the same outer diameter of the respective watch winder units 10 and the distance between the two second connectors 12 which have the same inner diameter of the respective watch winder units 10 are both L/2, and a distance from the first connectors 11 and the second connectors 12 to their respective neighboring side edges of the respective watch winder units 10 is L/4. The respective watch winder units 10 include a power switch 13, and the first connectors 11 are assembled in the second connectors 12 to assemble the watch winder units 10 in such a manner that the watch winder units 10 are electrically connected to one another.

The base 30 is provided with plural concave third connectors 31 for assembling with the raised first connectors 11. The power supply 20 is disposed inside the base 30 and electrically connected to the third connectors 31, or the power supply 20 can be disposed outside the base 30 or externally connected to the base 30. Alternatively, the third connectors 31 can be raised for assembling with the concave second connectors 12.

When the watch winder units 10 are assembled for use, the first connectors 11 of the watch winder units 10 will be assembled to the third connectors 31 of the base 30, so that the power supply 20 of the base 30 can supply power to the watch winder units 10. The plural third connectors 31 of the base 30 are used to install plural watch winder units 10 on the base 30, and then the watch winder units 10 can be assembled to other watch winder units 10. The watch winder units 10 which are assembled on the base are closely arranged, and the distance from the first connectors 11 and the second connectors 12 to the respective neighboring side edges of the respective watch winder units 10 is L/4, so that the distance between the two neighboring first connectors 11 or second connectors 12 of every two neighboring winder units 10 is L/2. With such arrangements, one watch winder unit 10 can be assembled on two winder units 10 in a straddling manner, so that the watch winder units 10 can be assembled as desired.

Figure 5:
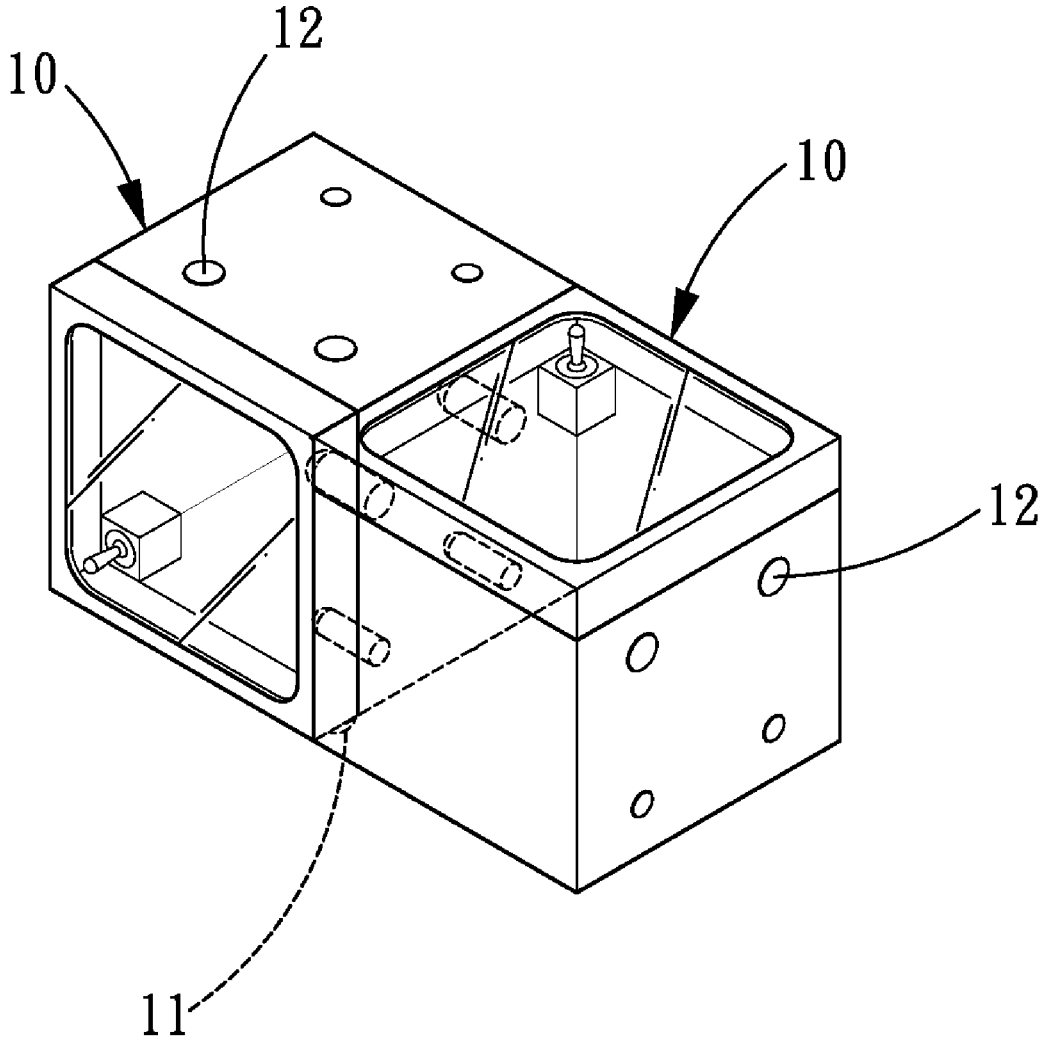
FIG. 5 is a perspective view of a watch winder in accordance with another embodiment of the present invention.

Additionally, the first connectors 11 and the second connectors 12 of the respective watch winder units 10 are not limited in number and position. As shown in FIG. 5, the first connectors 11 and the second connectors 12 of one of the watch winder units 10 are provided on two neighboring sides, and the first connectors 11 and the second connectors 12 of the other of the watch winder units 10 are provided on two opposite sides. Further, the connectors 11, 12, 13 are not limited to the raised and concave configurations. When the watch winder units 10 are out of use, in order to prevent first connectors 11 and the second connectors 12 from being oxidized by air, a protector (not shown) can be provided to cover the respective first and second connectors 11, 12. The protector can be made of foam material which has the characteristics such as soft, water proof and insulation, so that the protectors can be filled in the concave second connectors 12 to prevent the oxidization of the second connectors 12 which will be out of use for a long time and protect the electrically conductive property of the second connectors 12. In addition, since the soft foam material has the shock-absorption effect, the protectors can further protect the winder units 10. The protectors can also be made of plastic material for protecting the raised first protectors 11, so that the protectors can be engaged outside the first connectors 11 to offer the water-proof and insulation functions.

While we have shown and described various embodiments in accordance with the present invention, it is clear to those skilled in the art that further embodiments may be made without departing from the scope of the present invention.

What is claimed is:

1. A watch winder comprising plural watch winder units and a power supply, each of the winder units including four raised first connectors and four concave second connectors, the first connectors and the second connectors being all made of electrically-conductive material, the first connectors of one of the winder units being assembled in the second connectors of another winder unit in such a manner that two winder units are electrically connected, each of the winder units further includes a power switch, and the power switches control on/off of the respective winder units, the power supply is electrically connected to the watch winder units; wherein:

every two of the four first connectors of the respective watch winder units are equal in diameter and electrically connected to each other, and every two of the four second connectors of the respective watch winder units are also equal in diameter and electrically connected to each other, the two electrically-connected first connectors have a small diameter and are negative, the other two electrically-connected first connectors have a large diameter and are positive, the two electrically-connected second connectors have a small diameter and are negative, the other two electrically-connected second connectors have a large diameter and are positive;

a distance between the two first connectors having the same diameter and a distance between the two second connectors having the same diameter of the respective watch winder units are both half of a width of the respective watch winder units, and a distance from the first connectors and the second connectors to their respective neighboring side edges of the respective watch winder units is a quarter of the width of the respective watch winder units.

2. The watch winder as claimed in claim 1, wherein the power supply is disposed inside one of the watch winder units.

3. The watch winder as claimed in claim 1, wherein the power supply is disposed outside one of the watch winder units or externally connected to one of the watch winder units.

4. The watch winder as claimed in claim 1, wherein the first connectors and the second connectors are disposed on opposite outer sides of the respective watch winder units.

5. The watch winder as claimed in claim 1, wherein the respective watch winder units are equipped with a protector for protecting the first connectors or the second connectors.

6. The watch winder as claimed in claim 5, wherein the protector is made of foam material.

7. The watch winder as claimed in claim 5, wherein the protector is made of plastic material.

8. The watch winder as claimed in claim 1, wherein the electrically-conductive material is copper.

* * * * *